US005852455A

United States Patent [19]

Van Ham et al.

[11] Patent Number: 5,852,455

[45] Date of Patent: Dec. 22, 1998

[54] IMAGE FORMING DEVICE, HAVING SEPARATELY ENERGIZABLE, INTER-CONNECTED ELECTRODES AND IMAGE RECORDING ELEMENT FOR USE, THEREIN

[75] Inventors: Rob Adrianus Maria Van Ham; Paulus Henricus Eijmberts, both of Eindhoven; Augustinus Mathias Wilhelmus Cox, Roermond, all of Netherlands

[73] Assignee: OCE-Nederland, B.V., Ma Venlo, Netherlands

[21] Appl. No.: 946,064

[22] Filed: Oct. 7, 1997

Related U.S. Application Data

[63] Continuation of Ser. No. 279,023, Jul. 22, 1994, abandoned.

[30] Foreign Application Priority Data

Jul. 23, 1993 [NL] Netherlands ..... 9301300

[51] Int. Cl.[6] ..... B41J 2/06; B41J 2/39; B41J 2/395; B41J 2/40

[52] U.S. Cl. ..... 347/55; 347/141

[58] Field of Search ..... 359/245; 347/55, 347/111, 140, 143, 145, 148, 141, 158

[56] References Cited

U.S. PATENT DOCUMENTS 3,946,402 3/1976 Lunde ..... 347/55
5,198,920 3/1993 Gobeli et al. ..... 359/245

FOREIGN PATENT DOCUMENTS 0191521 8/1986 European Pat. Off. .
0247694 12/1987 European Pat. Off. .
0247699 12/1987 European Pat. Off. .
0304983 3/1989 European Pat. Off. .
A 62/189482 8/1987 Japan .
A 4/248573 9/1992 Japan .

OTHER PUBLICATIONS

Dutch Search Report.

*Primary Examiner*—Benjamin R. Fuller
*Assistant Examiner*—Raquel Yvette Gordon
*Attorney, Agent, or Firm*—Birch, Stewart, Kolasch, & Birch, LLP

[57] ABSTRACT

An image-forming device with a repeatedly usable image-recording element bearing a dielectric surface layer, beneath which is a system of separately energizable image-forming electrodes interconnected by a material whose resistance is between that of the dielectric surface layer and that of the image-forming electrode and is preferably a factor of $10^2$–$10^4$ lower than that of the dielectric surface layer, the dielectric surface layer and the material having the lower resistance preferably being formed as one continuous layer which bottom part has a lower resistance than in the top part.

6 Claims, 2 Drawing Sheets

IMAGE FORMING DEVICE, HAVING SEPARATELY ENERGIZABLE, INTER-CONNECTED ELECTRODES AND IMAGE RECORDING ELEMENT FOR USE, THEREIN

This application is a continuation of application Ser. No. 08/279,023 filed on Jul. 22, 1994, now abandoned.

BACKGROUND OF THE INVENTION

1. Field of the Invention

The invention relates to an image-forming device, and more specifically, to an image-forming device having a novel movable image-recording element.

2. Discussion of Related Art

Image-forming devices and image-recording elements usable therein as referred to above are described, inter alia, in European patents 0,191,521, 0,247,694, and 0,247,699.

In these known devices, a toner powder image recorded on the image-recording element in the image-forming zone is transferred directly or indirectly via an intermediate to a receiving material, such as ordinary paper, and fixed thereon. The image-recording element is then used again for a subsequent image-recording cycle. With these types of image-forming devices, of course, the longest possible life is required of the image-recording element. One problem which arises is that the repeated mechanical, electrical and thermal loading to which the image-recording element is subjected causes one or more fractures to occur in the image-forming electrode or electrodes themselves or in the connection between the image-forming electrode or electrodes and the electric energizing means, so that the electrode "floats" and is no longer energized. A floating image-forming electrode provides no further contribution to the image-forming, and this becomes visible on the print in the form of a fine toner-free streak in the image pattern. In addition, it is regularly observed that toner is deposited in the image-free portions, so that a fine toner streak is formed on the print in those portions. The presence of one floating image-forming electrode, therefore, makes it desirable to replace the image-recording element.

SUMMARY OF THE INVENTION

Therefore, it is an object of the present invention to provide an image-forming device which will overcome the above noted disadvantages.

A further object of the present invention is to provide an image-forming device having an improved image-recording element so that the above adverse effects visible on the print due to the fact that an image-forming electrode cannot be directly energized no longer occur to a disturbing degree.

The foregoing objects and others are accomplished in accordance with the present invention, generally speaking, by providing an image-forming device having a movable image-recording element comprising a support with a dielectric surface layer beneath which there is disposed a system of separately energizable image-forming electrodes, an image-forming zone situated along the path of movement of the image-recording element in which zone a counter electrode is disposed a short distance above the dielectric surface of the image-recording element, and an energization means for applying a voltage between the image-forming electrodes of the image-recording element and the counter electrode in accordance with an image pattern to be recorded, in order that toner powder supplied in the image-forming zone may be selectively deposited on the surface of the image-recording element in accordance with the image pattern. The device according to the invention is characterized in that the separately energizable image-forming electrodes beneath the dielectric surface layer are interconnected in the image-recording element by a material having an electrical resistance between that of the dielectric surface layer and that of the image-forming electrode and this resistance is so selected that an image-forming electrode that cannot be directly energized by the energization means is energized at such a level, on energization of the image-forming electrode nearest the image-forming zone so that toner powder is deposited on the dielectric surface situated thereabove. Disposing directly beneath the dielectric surface layer a material which is relatively conductive in relation to the layer and which interconnects the image-forming electrodes has the effect that an image-forming electrode which can no longer be directly energized due to a break in the connection to the energizing means is energized on energization of the nearest electrode. Consequently, a quantity of toner is also deposited above the non-operating image-forming electrode, so that the occurrence of disturbing toner-free streaks in image patterns is obviated. Another effect is that no toner is deposited in the image-free portions above an image-forming electrode which cannot be directly or indirectly energized.

Thus, according to the invention, if an image-forming electrode can no longer be directly controlled, the consequences thereof on the print are not visible or are not visible to a disturbing degree, so that there is no need to replace the image-forming element immediately and hence a longer life is achieved. In the image-forming element of the image-forming device according to the present invention, the image-forming electrodes are interconnected by a material situated directly beneath the dielectric surface layer and having a resistance between that of the dielectric surface layer and that of the image-forming electrodes. The resistance is so selected that an image-forming electrode which can no longer be directly controlled by the energizing means is energized to such a level, on energization of the nearest image-forming electrode, that toner powder is deposited on the dielectric surface thereabove. The resistance to be selected depends on the distance between the image-forming electrodes, the resistance of both the image-forming electrodes and the dielectric surface layer, and the electrical conductivity of the toner powder used for the image-recording.

It has been determined that with image-forming elements as described in the above prior art, in which the dielectric surface layer has a resistivity of between $10^9$ and $10^{12}$ Ωcm and a thickness between 0.2 and 0.8 μm, the distance between successive image-forming electrodes is 15–25 μm and the toner powder used for the image-recording has a resistivity of between $10^3$ and $10^6$ Ωcm (measured as described in European patent application 0,441,426), this resistance of the interconnecting material should be a factor of $10^2$ to $10^4$ lower than that of the dielectric surface layer. The lower resistance material connecting the image-forming electrodes can be disposed directly beneath the dielectric surface layer between the image-forming electrodes, but according to one preferred embodiment of the invention, the material is applied as a continuous layer over an insulating substrate in which the image-forming electrodes are embedded at the surface. In the latter case, the thickness of the applied layer is preferably about 0.2 to 0.5 μm. The disadvantage of a thicker layer is that the distance between an image-forming electrode and the surface of the dielectric layer still to be applied becomes relatively large, and this may have an adverse effect on the sharpness of the images to be recorded.

The lower resistance material can, in principle, consist of any material having the required electrical resistance. It may, for example, be formed from a binder in which conductive material is finely distributed, such as carbon black, metal particles (e.g. copper or silver particles), metal complexes (e.g. as described in U.S. Pat. No. 3,245,833), quaternary ammonium compounds or conductive polymers or mixtures of such materials or other conductive materials known per se.

According to another preferred embodiment of the invention, the dielectric surface layer and the layer of connecting material therebeneath are in the form of a continuous layer having an increasing resistance towards the surface. A layer of this kind can be formed by a known chemical deposition process, such as sputtering or vapor coating, the conditions of the deposition process being so controlled that the resulting layer has in the bottom portion of the layer a resistance lower by the required level (e.g. a factor of $10^2$–$10^4$) than in the top part of the layer. According to this preferred embodiment of the invention, a thin layer is formed, for example, by a known sputtering process, consisting of an oxide or nitride, such as silicon oxide, aluminum oxide, silicon nitride and zinc oxide, the oxygen or nitrogen proportion of which in the molecular lattice increasing from bottom to top, or is relatively low in the bottom half and relatively high in the top half, thus giving the required differential resistance.

According to a particularly preferred embodiment of the invention, the thin layer applied by a chemical deposition process consists of a layer of silicon oxide about 0.8 $\mu$m thick, the bottom portion of the layer having a thickness of about 0.2–0.5 $\mu$m consisting of $SiO_x$, where x is approximately or on the average of about 0.40–0.65, and the top part of the layer consisting of $SiO_x$, where x is approximately or on the average of about 1.2–1.6.

BRIEF DESCRIPTION OF THE DRAWINGS

The invention will be explained in detail with reference to the accompanying drawings wherein.

DETAILED DISCUSSION OF THE INVENTION

Figure 1:
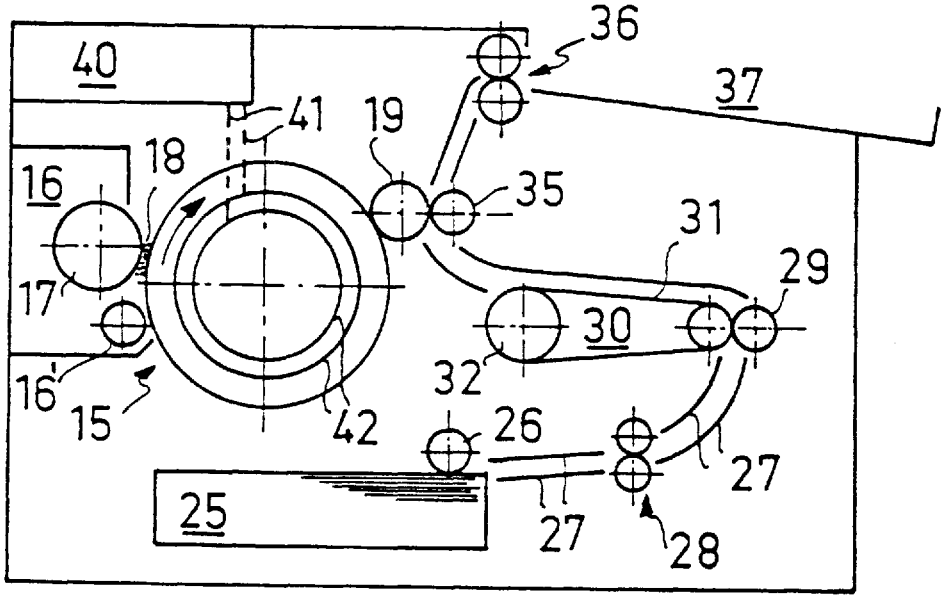
FIG. 1 is a diagrammatic illustration of the principle of an image-forming device according to the invention.

The image-forming device according to FIG. 1 is provided with an image-recording element 15, which will be described hereinafter in detail with reference to FIG. 2. The image-recording element 15 passes through an image-forming station 16, where its surface is provided with a uniform layer of toner powder having a resistivity of about $10^5$ Ωcm, by means of a toner deposition means 16' comprising a conventional magnetic roller carrying on its outer surface a layer of toner powder which is transferred to the image recording element 15 under the influence of an electric potential difference generated between means 16' and the image recording element 15. Means 16' are constructed as described in U.S. Pat. No. 3,946,402.

The powdered surface of the image-recording element 15 is then passed through an image-forming zone 18, where a magnetic roller 17 is disposed a short distance from the surface of the image-recording element 15, the roller 17 comprising a rotatable electrically conductive non magnetic sleeve and a stationary magnet system disposed inside the sleeve. The stationary magnet system comprises a ferromagnetic knife blade clamped between like poles of two magnets and is constructed as is more specifically described in European patent application 0,304,983. By application of a voltage between one or more image-forming electrodes of the image-recording element 15 and the conductive sleeve of the magnetic roller 17 acting as a counter electrode, a powder image is formed on the image-recording element. When no image is recorded, the magnetic roller 17 and the image-forming electrodes of the image-recording element 15 are at earth potential. During image-recording, the image-forming electrodes involved are brought to a positive potential of about 30 volts. This powder image is transferred, by the application of pressure to a heated rubber covered roller 19. A sheet of paper is taken from a supply stack 25 by roller 26 and fed to a heating station 30 via guideways 27 and rollers 28,29. Heating station 30 comprises a belt 31 running about a heated roller 32. The sheet of paper is heated by contact with the belt 31. The sheet heated in this way is then fed through the roller 19 and a pressure roller 35, the softened powder image on the roller 19 being completely transferred to the sheet of paper. The temperatures of the belt 31 and the roller 19 are so adapted to one another that the image fuses to the sheet of paper. The sheet of paper provided with an image is fed to a collecting tray 37 via conveyor rollers 36.

Unit 40 comprises an electronic circuit which converts the optical information of an original into electrical signals which are fed to the control elements 3 (see FIG. 2), via wires 41 having sliding contacts, and conductive tracks 42 disposed in the side wall of the image-recording element 15, the control elements 3 being connected to the tracks 42. The information is fed serially line by line to the shift register of the integrated circuits of the elements 3. If the shift registers are completely filled in accordance with the information of one line, that information is placed in the output register and voltage is either applied or not applied to the electrodes 6, 5 (see FIG. 2) via the drivers depending on the signal. While this line is being printed the information of the next line is fed to the shift registers.

Apart from optical information from an original, electrical signals originating from a computer or a data-processing device can also be converted in unit 40 to signals fed to the control elements 3.

Figure 2:
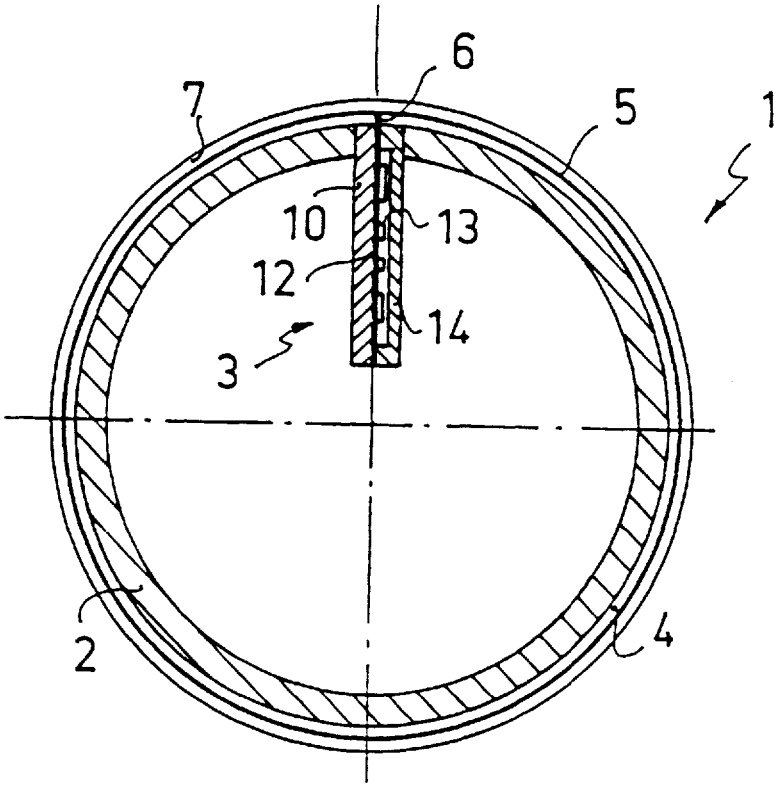
FIG. 2 is a cross-section of a preferred embodiment of an image-recording element for use in the device according to FIG. 1.

The image-recording element used in the image-forming device according to FIG. 1 is shown in diagrammatic cross-section in FIG. 2. The image-recording element 1 shown in FIG. 2 comprises a cylinder 2 having mounted therein a control element 3 which extends axially and which has a construction which will be described in detail hereinafter. The cylinder 2 is covered with an insulating layer 4, on which image-forming electrodes 5 are disposed and extend in the form of endless tracks parallel to one another at substantially equal spacing in the peripheral direction of the cylinder 2. One image-forming electrode 5 in each case is conductively connected to one control electrode 6 of the control element 3. The number of control electrodes 6 of the control element 3 is equal to the number of image-forming electrodes 5, such number governing the quality of the images to be formed on the image-recording element 1. The image quality improves with an increasing electrode density.

To achieve a good quality, the number of image-forming electrodes 5 is at least 10 per mm and preferably 14 to 20 per mm. According to one specific embodiment the number of electrodes 5 is equal to 16 per mm, the electrodes 5 having a width of 40 $\mu$m and the distance between the electrodes being about 20 $\mu$m.

Finally, the pattern of image-forming electrodes 5 is covered with a top layer 7. The control element 3 comprises a support 10 which is provided in a known manner with an electrically conductive metal layer (such as copper), which metal layer is then converted to the required conductive track pattern 12 in the manner to be described hereinafter. The track pattern 12 consists, on the one hand, of the conductive connections between the various electronic components 13 of the control element 3 and, on the other hand, the control electrodes 6, one of which in each case being conductively connected to one image-forming electrode 5. The control element 3 also comprises a cover 14 which is connected to the support 10 in a known manner (e.g. glued), to form a box-shaped control element 3 in which the electronic components are enclosed. The electronic components 13 comprise a number of integrated circuits known, for example, from video display technology, comprising a serial-in parallel-out shift register, an output register, and, connected thereto, drivers having a voltage range of 25 to 50 volts for example. One control electrode 6 is connected to one driver of one of the integrated circuits.

The image-recording element 1 is made as follows. A control element 3 is made from a metal core substrate consisting of an aluminum support plate on which a copper foil is glued by means of an epoxy resin especially developed for the electronics industry, known as an "electronic grade" epoxy resin, the control element 3 being made by converting the copper foil, by a known photoetching technique, into a conductive track pattern 12 which comprises both the conductive connecting tracks for the electronic components 13 to be placed on the support 10, and the conductive tracks for the control electrodes 6. The electronic components 13 are then fixed on the support 10 at the correct place determined by the conductive connecting tracks, and the cover 14 is glued to the support 10 with an electronic grade epoxy resin.

The control element 3 in box form thus made is then placed in an axial slot formed in the wall of the aluminum cylinder 2, and is glued therein by means of the above mentioned epoxy resin glue. The axial slot is at least as long as the operative width of the image-recording element 1. With regard to the width of the axial slot in the cylinder 2, the space between the control element 3 and the wall of the slot must be so dimensioned that the space can be filled by the glue by capillary action. Too large a space results in the glue running out. The outer surface of the cylinder 2 with the control element 3 fixed therein is then turned to a predetermined degree and brought into contact with a suitable etching liquid, (e.g. a known alkaline potassium ferricyanide solution) so that the metal of the top layer of both the cylinder 2, the support 10 and the cover 14 is etched away over a given depth, e.g. 150 $\mu$m. The etching liquid is so selected that the metal of the control electrodes 6 is only slightly affected, so that the ends of these electrodes finally project about 150 $\mu$m above the surface of the cylinder 2 and the control element 3. The surface of the cylinder 2 is then covered with an insulating intermediate layer 4 of electronic grade epoxy resin having a layer thickness corresponding to the length of the projecting ends of the electrodes 6, so that the end faces thereof lie at the outer surface of the insulating intermediate layer 4. This is achieved by applying a thicker intermediate layer 4 and then removing this layer by turning at least until the end faces of the electrodes 6 are exposed at the surface of the intermediate layer 4. The image-forming electrodes 5 are formed by machining (e.g. on a lathe) a number of peripherally and parallel extending endless grooves in the outer surface of the intermediate layer 4. The groove pattern is so applied that it corresponds completely (as regards density and location) to the pattern of control electrodes 6, so that one control electrode 6 cooperates with one groove. The grooves are filled by copper vapor deposition and removal of the surface by turning, thus producing the conductive image-forming electrodes 5.

The pattern of image-forming electrodes is finally covered with a smooth top layer 7. This is an approximately 0.8 $\mu$m thick layer of silicon oxide, in which the bottom part in a thickness of about 0.4 $\mu$m consists of $SiO_x$ where x=±0.5 and the top layer part consists of $SiO_x$ where x=±1.5. The silicon oxide layer is applied by a known sputter technique in a vacuum chamber, e.g. of the Balzers LLS 801 type, silicon being sputtered from a silicon target with the introduction of argon and oxygen into the chamber, and in the first phase of the sputtering process the supply of oxygen is so set that $SiO_x$, wherein x=±0.5, is applied and in the second phase of the process the oxygen supply is increased so that $SiO_x$, wherein x=±1.5, is formed. The quantity of oxygen to be introduced to achieve the required $SiO_x$ composition can be determined by experiment by making a number of samples by varying the quantity of oxygen introduced and determining the silicon/oxygen ratio of the $SiO_x$ layer on the various samples by EDX analysis (Energy Dispersive X-ray Analysis). Before the samples are analyzed the analyzer (Tracor TN 5500 of Tracor Europe, Amersfoort, Netherlands) is calibrated with a reference standard of at least 99.9% $SiO_2$. A layer of carbon some tens of nanometers thick is vapor coated over the $SiO_x$ layer of the samples to be measured, as is known with EDX analysis. This vapor coated carbon layer is also present on the reference standard.

A first image-recording element was made as described above, and during the production of the control element 3, the connection between some of the control electrodes 6 distributed over the element and the control electronics 30 was broken by removing part of the metal track. A second image-recording element was made correspondingly, but now with a top layer 7 which had a thickness of about 0.5 $\mu$m and consisted entirely of $SiO_x$, wherein x=±1.5. Both image-recording elements were used in an image-forming device as described with reference to FIG. 1. The prints obtained with the first image-recording element were of good quality. The prints made with the second image-recording element, however, had fine toner-free streaks in the image portions at the location of the non-controllable image-forming electrodes, while fine toner streaks were visible in the background areas. Using the image-recording element according to the invention it was possible to obtain good quality images with a control voltage of 25 volts for the image-forming electrodes. Using the other image-recording element, a control voltage of 30 volts was required to achieve a comparable image quality. Thus, the invention also provides the advantage of a lower control voltage for the image-forming electrodes.

Figure 3:
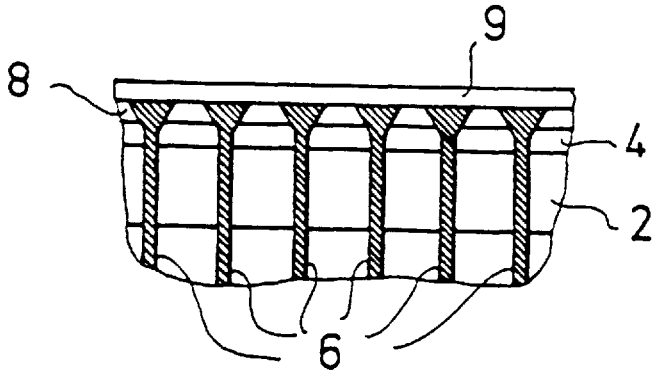
FIG. 3 is a longitudinal cross-section of another embodiment of an image-recording element for use in the device according to FIG. 1.

FIG. 3 shows another possible embodiment of a suitable image-recording element. This image-recording element differs from the element described with reference to FIG. 2 solely in that a thin layer of connecting material is applied between the image-forming electrodes and directly beneath the dielectric surface layer. Up to and including the application of the insulating layer 4 this image-recording element was made in the same way as the element shown in FIG. 2. A layer 8 about 1 μm thick of epoxy resin with carbon particles dispersed therein was then applied over the insulating layer 4, and had a resistance of about $10^6\Omega$. The grooves were then formed in the surface, the layer 8 being completely removed at the location of the grooves. The grooves were filled with copper as described hereinbefore, whereupon the turned cylinder surface was provided with a dielectric top layer 9 having a thickness of about 0.5 μm and again consisting of $SiO_x$, x=±1.5.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An image-forming device comprising:

a movable image-recording element includes a support with a dielectric surface layer thereon, a system of separately energizable image-forming electrodes said system of separately energizable electrodes having a surface and is disposed beneath said dielectric surface layer and on a surface of said movable image recording element, an image-forming zone situated along a path of movement of said movable image-recording element, a counter electrode being disposed juxtapositioned above said dielectric surface of said movable image-recording element in said image-forming zone, and energization means for applying a voltage between said image-forming electrodes and said counter electrode in accordance with an image pattern to be recorded, in order that toner powder supplied to said image-forming zone may be deposited on the dielectric surface of said movable image-recording element in accordance with said image pattern, wherein said separately energizable image-forming electrodes disposed beneath said dielectric surface layer are interconnected in the movable image-recording element by a material having an electrical resistance between that of the dielectric surface layer and that of the image-forming electrodes and the electric resistance is so selected wherein an image-forming electrode that cannot be directly energized by said energization means is energized at a predetermined level, on energization of one of said separately energizable image-forming electrode nearest to said image forming zone, such that toner powder is deposited on the dielectric surface situated thereabove.

2. The image-forming device according to claim 1, wherein a continuous layer having a bottom portion and a top portion and having resistance being a factor of $10^2$–$10^4$ lower than that of said dielectric surface layer is present in the image-recording element beneath said dielectric surface layer and over the surface of the separately energizable image-forming electrodes.

3. The image-forming device according to claim 1, wherein said material is a continuous layer and consists of an oxide or nitride.

4. The image-forming device according to claim 1, wherein said material is a continuous layer having a bottom portion and a top portion and consists of $SiO_x$, wherein x in the bottom portion of the continuous layer is on an average of about 0.4–0.65 and in the top portion of the continuous layer on an average of about 1.2–1.6.

5. An image-forming device comprising:

a movable image-recording element includes a support with a dielectric surface layer thereon, a system of separately energizable image-forming electrodes said system of separately energizable electrodes having a surface and is disposed beneath said dielectric surface layer and on a surface of said movable image recording element, an image-forming zone situated along a path of movement of said movable image-recording element, a counter electrode being disposed juxtapositioned above said dielectric surface of said movable image-recording element in said image-forming zone, energization means for applying a voltage between said image-forming electrodes and said counter electrode in accordance with an image pattern to be recorded, in order that toner powder supplied to said image-forming zone may be deposited on the dielectric surface of said movable image-recording element in accordance with said image pattern, and the surface of said separately energizable image-forming electrodes in said image-forming element is covered by a continuous dielectric surface layer having a bottom portion and a top portion and having a resistance in said bottom portion of the continuous layer which is lower relative to a resistance in said top part of the continuous layer, wherein separately energizable image-forming electrodes beneath said dielectric surface layer are interconnected in the movable image-recording element by a material having an electrical resistance between that of the dielectric surface layer and that of the image-forming electrodes and the electric resistance is so selected wherein an image-forming electrode that cannot be directly energized by said energization means is energized at a predetermined level, on energization of one of said separately energizable image-forming electrode nearest to said image-forming zone, such that toner powder is deposited on the dielectric surface situated thereabove.

6. An image-forming device comprising:

a movable image-recording element includes a support with a dielectric surface layer thereon, a system of separately energizable image-forming electrodes said system of separately energizable electrodes having a surface and is disposed beneath said dielectric surface layer and on a surface of said movable image recording element, an image-forming zone situated along a path of movement of said movable image-recording element, a counter electrode being disposed juxtapositioned above said dielectric surface of said movable image-recording element in said image-forming zone, energization means for applying a voltage between said image-forming electrodes and said counter electrode in accordance with an image pattern to be recorded, in order that toner powder supplied to said image-forming zone may be deposited on the dielectric surface of said movable image-recording element in accordance with said image pattern, and said support, having a dielectric surface layer thereon, beneath which there is provided a system of image-forming electrodes, wherein the dielectric surface layer is in a form of a continuous layer having a bottom portion and a top portion formed from an oxide or nitride consisting of $SiO_x$, wherein x in the bottom portion of the continuous layer is on an average of about 0.4–0.65 and in the top portion of the continuous layer on an average about 1.2–1.6, said bottom portion of said continuous layer has a resistance $10^2$–$10^4$ lower relative to said top portion of said continuous layer, wherein separately energizable image-forming electrodes beneath said dielectric surface layer are interconnected in the movable image-recording element by a material having an electrical resistance between that of the dielectric surface layer and that of the image-forming electrodes and the electric resistance is so selected wherein an image-forming electrode that cannot be directly energized by said energization means is energized at a predetermined level, on energization of one of said separately energizable image-forming electrode nearest to said image-forming zone, such that toner powder is deposited on the dielectric surface situated thereabove.

* * * * *